United States Patent [19]

Oberdorfer-Bögel

[11] Patent Number: 5,068,555

[45] Date of Patent: Nov. 26, 1991

[54] DUST EXHAUSTER FOR A VACUUM CLEANER HAVING IMPROVED COOLING

[76] Inventor: Rainer Oberdorfer-Bögel, Mozartstrasse 9, Kirchberg/Iller, Fed. Rep. of Germany 7959

[21] Appl. No.: 566,735

[22] Filed: Aug. 13, 1990

[30] Foreign Application Priority Data

Aug. 26, 1989 [DE] Fed. Rep. of Germany ..... 3928313

[51] Int. Cl.[5] ..... A47L 9/00

[52] U.S. Cl. ..... 310/52; 310/51; 310/60 A; 15/326

[58] Field of Search ..... 310/52, 58, 59, 60 A, 310/51; 15/300 R, 326

[56] References Cited

U.S. PATENT DOCUMENTS 4,665,581 5/1987 Oberdorfer ..... 15/326

*Primary Examiner*—Steven L. Stephan
*Assistant Examiner*—Edward H. To
*Attorney, Agent, or Firm*—Nilsson, Robbins, Dalgarn, Berliner, Carson & Wurst

[57] ABSTRACT

A dust exhauster is described whose electric motor is designed as a commutatorless dc motor. The electrical and electronic components of the dust exhauster are positioned according to the invention within the motor cooling air intake channel. Consequently, they are directly cooled by the stream of cooling air, resulting in a substantially extended service life for these components. Furthermore, the motor with its components is relatively small in design.

3 Claims, 4 Drawing Sheets

DUST EXHAUSTER FOR A VACUUM CLEANER HAVING IMPROVED COOLING

BACKGROUND OF THE INVENTION

The invention concerns a dust exhauster with an electric motor which is mounted between a lower support plate and an upper anchoring plate also having electric or electronic components mounted on boards in the flow-through housing and an intake channel and an exhaust channel for the motor cooling air.

Such dust exhausters are known. Their electric motors are designed as asynchronous motors. They therefore require relatively bulky power and control electronics which have usually been installed on two separate European-format boards. Because of this bulk it was impossible to place the boards with their components directly in the flow of the motor cooling air. Therefore, the components quickly became quite hot and, consequently, their service life suffered appreciably.

The object of the invention is to provide a dust exhauster of this type which is remarkable in particular for a substantial extension of the service life of its electric and electronic components. The components are also arranged in a housing in such a way as to save space and to be readily replaceable.

SUMMARY OF THE INVENTION

To meet this objective, the invention is characterized in that in addition to designing the electric motor as a commutatorless D.C. motor at least one of the boards with its components is positioned within the motor cooling air intake channel, with this intake channel being essentially U-shaped with a first leg in the flow direction, a horizontal section connected to the first leg, and a second leg connected to the horizontal section and with this intake channel being hermetically connected to the upper part of the electric motor.

It is thus possible to install the boards with their components in the first leg, in the horizontal section, and/or in the second leg where the motor cooling air passes directly through them cooling them efficiently. They can also be readily replaced, as will be explained in greater detail below.

DETAILED DESCRIPTION OF THE INVENTION

Figure 1:
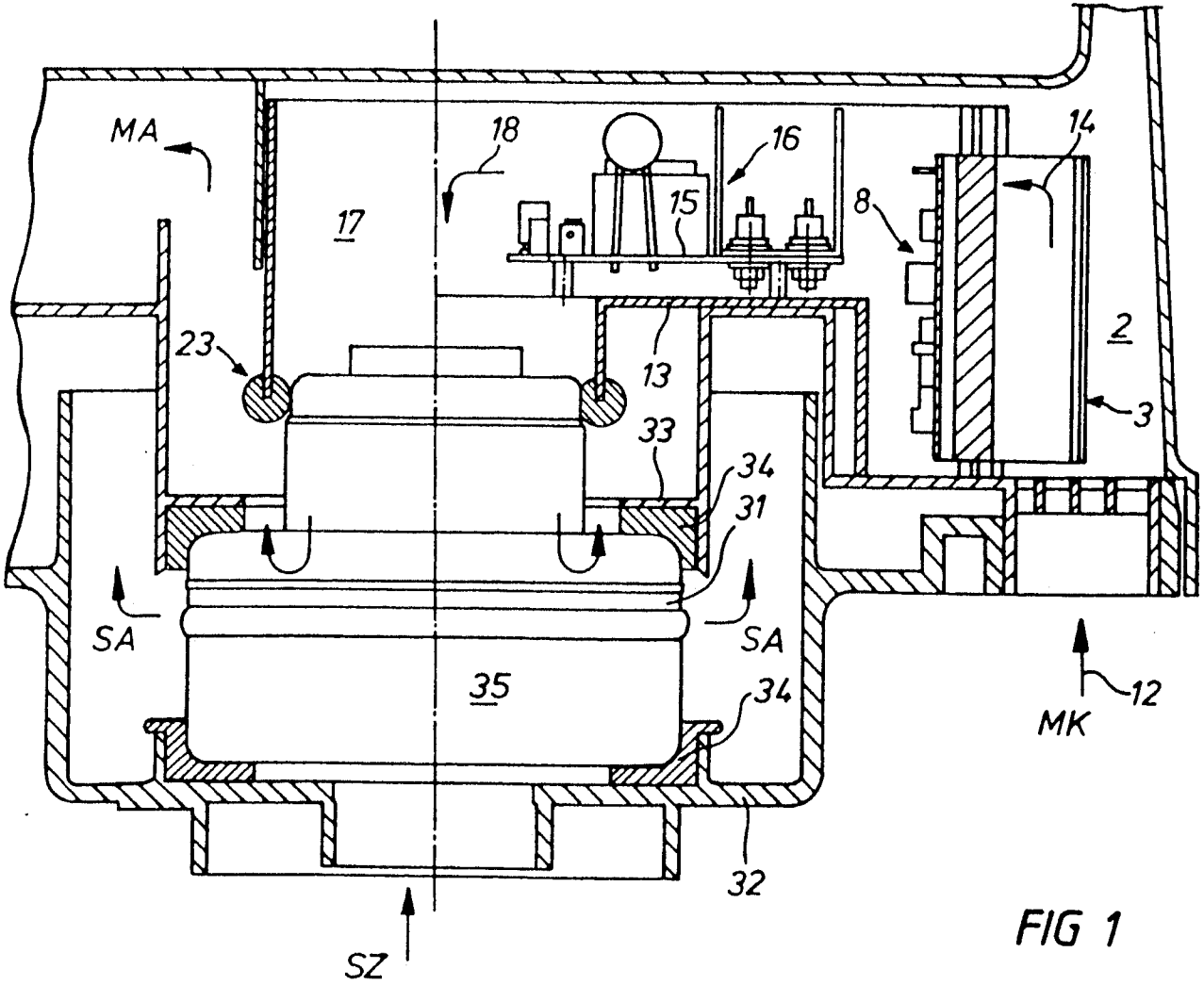
FIG. 1 is a cutaway view through the essential components of interest here of an embodiment of a dust exhauster according to the invention cut along the Line A - B of FIG. 2.

Use of the commutatorless D.C. motor in place of the asynchronous motor otherwise used provides the advantage that a significantly smaller electric motor can be used, which, because of its reduced weight, has different vibrational behavior and whose frequency control can be handled by boards which are significantly smaller than the traditional boards for frequency control of asynchronous motors. The combination of these characteristics thus permits positioning the boards directly in the motor cooling air flow, yielding the desired substantial extension of the service life of these components.

The parts are also readily replaceable.

For installation, the intake channel with its one open tube (first leg) is placed on the intake opening already present for intake of cooling air for the motor on the upper anchoring plate of the motor and the other open tube (second leg) is placed directly on the stator of the motor and hermetically connected to it using an airtight ring seal.

In the event of defects and repairs, the entire unit with all its control electronics can thus be replaced without difficulty. The control electronics are positioned completely within the stream of the motor cooling air, upstream of the motor.

It is also significant here that because of the integration of all the control electronics and all the power supply components, only a few wiring leads are required. In principle, only one two-wire cable to supply the alternating current and one two-wire cable to supply power to the motor winding are needed, along with one additional control line to supply the relevant control signals to the electronically regulated motor.

This further assures easy replacement of the entire flow-through housing.

The compact design of this flow-through housing also guarantees that dust exhausters already in operation can be retrofitted with such a unit.

To accomplish this, the present A.C. motor is simply replaced by the new commutatorless D.C. motor, and the flow-through housing with its integrated electronics is simply installed on the upper anchoring plate already present.

Addition of such equipment with the flow-through housing described here is possible not only for single-motor applications but also for dust exhausters with several parallel motors in close proximity which are driven separately.

In this example, each motor is equipped with a flow-through housing of this type, with control of each motor performed separately via the circuitry electronics located in the respective flow-through housing.

It is important here that the open tube on the motor side of the housing with its integrated electronics is hermetically connected to the upper part of the motor, i.e., with the stationary winding section. And an outlet section is formed around the motor in the upper anchoring plate to assure that the cooling air feeds inward into the motor through the flow-through housing, flows through the motor, flows by the windings, turns approximately 180°, and flows out in the opposite direction from the incoming cooling air on the outside of the flow-through housing. Suitable motor noise abatement devices located in the outflow channel formed by the upper anchoring plate and the hood is also provided.

This exhaust stream is then discharged by known means through labyrinth channels located in the hood of the dust exhauster.

Attachment of this flow-through channel is carried out simply with two bolts.

In a first embodiment, it is possible to provide appropriately spaced brackets on the side wall of the flow-through channel which brackets have holes for bolts which are screwed into the top of the upper anchor plate.

The brackets may also be integrated into the flow-through housing itself, with the flow-through housing having holes, for example, in its base plate, through which bolts which also penetrate into the upper anchoring plate of the motor may be screwed.

Thus, the attachment system can be easily released, since on one side this flow-through housing is merely placed—as mentioned—on top of the cooling air intake grid of the upper anchoring plate of the motor and is hermetically connected on the other side to the stationary part of the motor—as described.

In the following, the invention is explained in greater detail using exemplary embodiments which reveal additional important characteristics.

Figure 2:
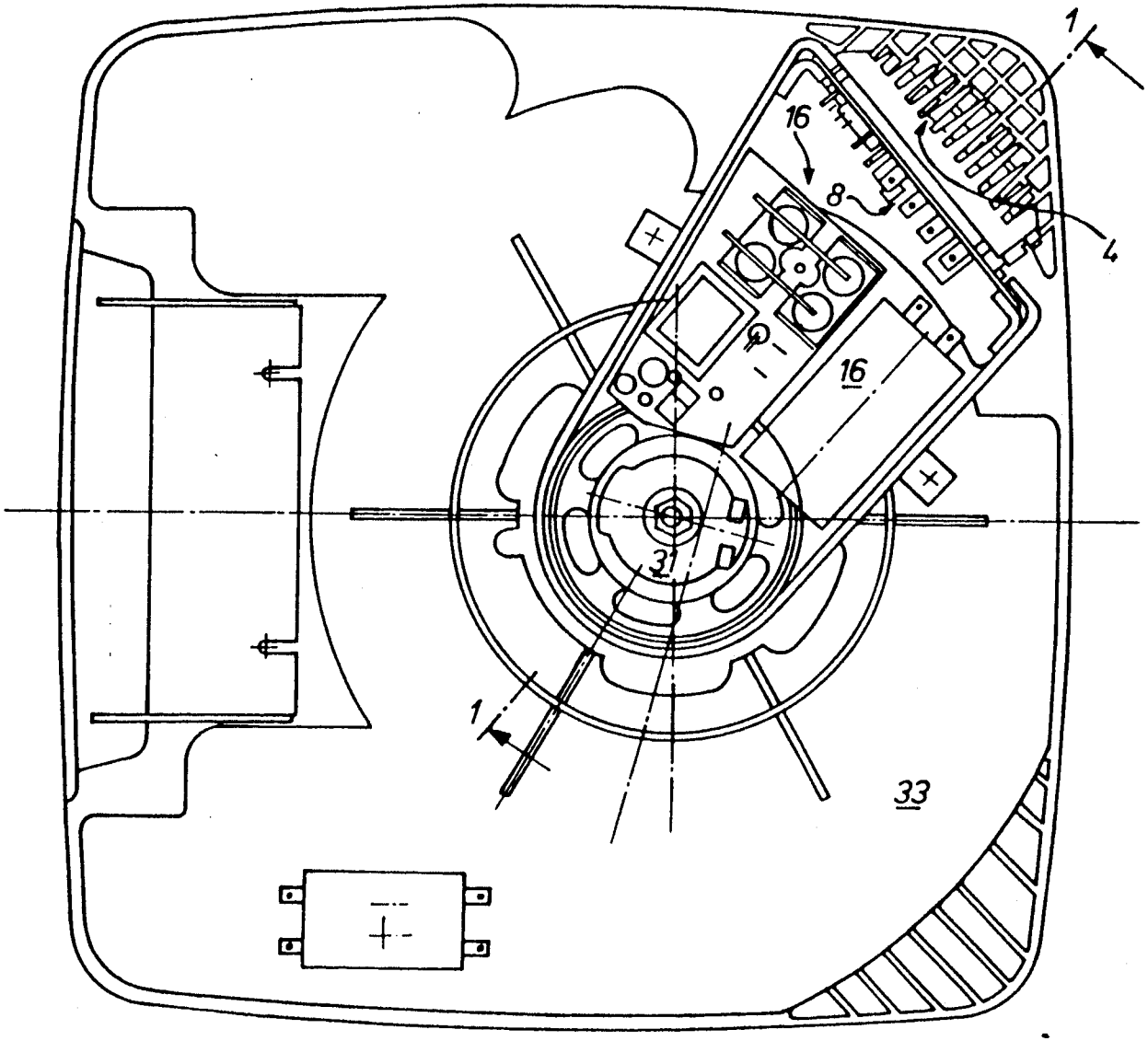
FIG. 2 is a top view of the embodiment of FIG. 1, with some parts omitted for the sake of clarity.

First, the basic design of the essential parts of interest here of the dust exhauster according to the invention is elucidated using FIG. 1 and 2.

Inside a flow through housing 1 an electric motor 31 is mounted between a lower support plate 32 and an upper anchoring plate 33 in such a way that it is readily replaceable, with the electric motor held by rubber elements 34 to reduce vibration. FIG. 1 also shows the turbine 35 of the dust exhauster, which is mounted directly underneath on the electric motor 31 itself.

The flow of the motor cooling air is indicated in FIG. 1 by MK; the flow of the motor exhaust, by MA; the flow of the vacuum intake air, by SZ; and the flow of the vacuum exhaust, by SA.

Figure 3:
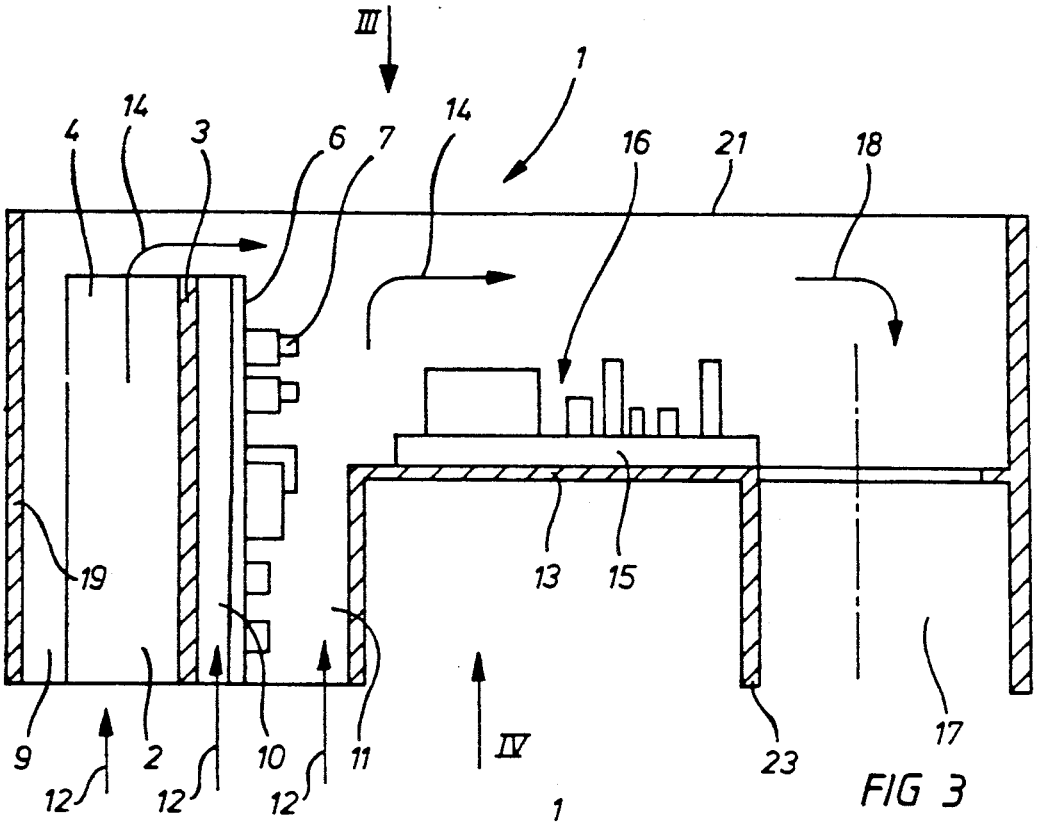
FIG. 3 is a cutaway view corresponding to FIG. 1 with an embodiment slightly altered to elucidate details.

A flow-through housing 1 for the motor cooling air corresponding to FIG. 3 is open on the top and has an upper edge 21. The top cover of this housing 1 above the upper edge 21 is formed by the inner side of the hood (not shown) of the dust exhauster. The flow through housing 1 is thus closed on all sides and has only the one open tube 2 and the other open tube 17.

To simplify the design of the housing 1, it is possible to omit the wall 19, which is slightly distorted in the top view, and to have this wall 19 formed by the wall of the hood or the upper anchoring plate of the dust exhauster.

Only the motor cooling air flows through the flow-through housing 1. The turbine intake air and the turbine exhaust flow separately into the exhaust channels between the upper anchoring plate and the support plate.

The present invention therefore deals with the management of the motor cooling air and the positioning of the electronic circuit elements in the region of this flow-through housing.

Figure 4:
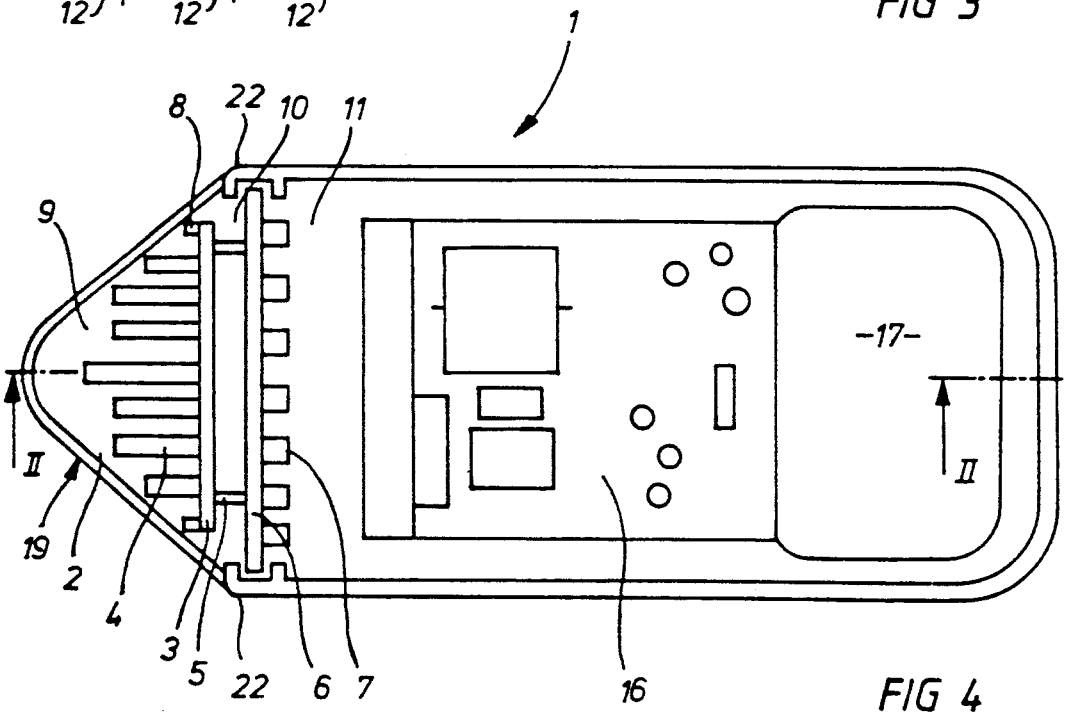
FIG. 4 is a top view of the embodiment of FIG. 3.
Figure 5:
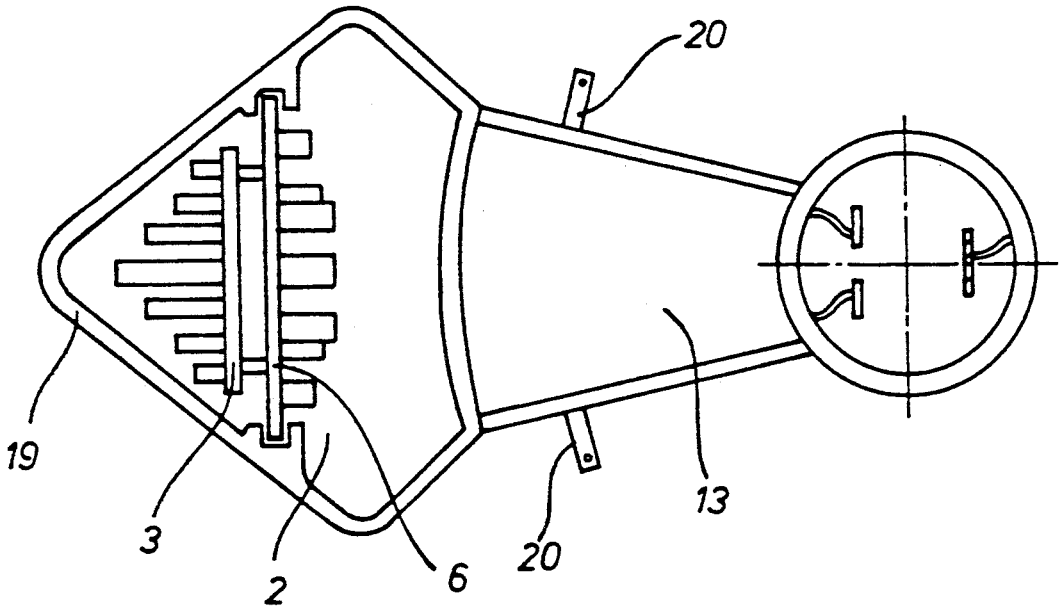
FIG. 5 is a view of a modification of the embodiment of FIG. 4.

FIG. 3 shows schematically that the housing essentially consists of two open tubes 2, 17 with a predetermined distance between them (see FIG. 4 and FIG. 5).

As shown in FIG. 4 a heat sink 3 with cooling ribs 4 is positioned in the open tube 2, with transistors 8 solidly attached to the heat sink 3 on the side surfaces of this heat sink. As shown in FIG. 3 this heat sink thus lies completely within the flow of the incoming cooling air, which enters the open tube 2 from below in the direction of the arrow 12.

The cooling air thus enters the column 9 between the heat sink 3 and the exterior wall 19 of the housing, the column 10 between the back of the heat sink 3 and the back of a board 6, and finally the column 11 between the front of the board 6 and the inner wall of the open tube 2, for yet another.

The wall 19 may be omitted and then as shown in FIG. 4 and FIG. 5 the sealing devices at reference numbers 22 are provided since in this region the open tube 2 meets the inside of the hood with an airtight seal and the open tube 2 is formed on the one side by the wall of the hood and on the other by the remaining walls of the housing 1.

After flowing through in the direction of the arrow 12, the air turns along the top of the open tube in the direction of the arrow 14 and then flows parallel to a base plate 13 on which an additional board 15 is positioned. This board 15 holds the power rectifier 16 along with heat sinks, cooling ribs, and other similar components to be cooled.

The air then continues its flow in the direction of the arrow 18 and then flows into the open tube 17 where the open tube is connected with an airtight seal at its bottom edge 23 to the stationary part of the motor in such a way that the air then flows through the winding of the motor in the direction of the arrow 18.

It can be seen that virtually all the electronic components are positioned in the region of the flow-through housing.

The electronics to be cooled are positioned directly on the upper anchoring plate of the motor within the incoming stream of motor cooling air.

It is also possible to position appropriate electronic components outside the flow-through housing.

Since provision is made to direct the exhaust flowing out from the motor into the space between the upper anchoring plate and the hood, appropriate electronic components to be cooled may also be positioned in this area, such as a mains suppression filter, an automatic on-and-off switch to turn the motor on and off during disturbances as well as an automatic cutoff to turn off a tool when dust exhauster flow falls below a specific minimum flow volume.

Thus, these components are quite simply positioned on the support plate and are still adequately cooled by the exhaust flow from the motor.

Previously, the high level of integration of the control electronics for the dust exhauster was mentioned and it was stated that virtually all electronic components for the power supply and the control of the motor are located in this flow-through channel. In addition, there are also significant advantages for assembly and inspection because a separate assembly line can be set up for the assembly of all the electronic components.

The attachment of flow-through housings like those described above is not limited to applications in dust exhausters with a single motor, but is also possible with large-scale dust exhausters in which a group of motors are installed, for example, around the circumference of a circle. The flow-through housings described according to the exposition of the present invention are installed radially positioned outward in a starlike pattern.

From the foregoing description, one skilled in the art can readily ascertain the essential characteristics of the invention and, without departing from the spirit and scope thereof, can adapt the invention to various usages and conditions. Changes in form and substitution of equivalents are contemplated as circumstances may suggest or render expedient, and although specific terms have been employed herein, they are intended in a descriptive sense and not for purposes of limitation.

KEY TO DRAWINGS

1. Flow-through housing
2. Open tube
3. Heat sink

4. Cooling ribs
5. Bolts
6. Board
7. Circuitry components
8. Transistors
9. Column
10. Column
11. Column
12. Direction of arrow
13. Base plate
14. Direction of arrow
15. Board
16. Power rectifier
17. Open tube
18. Direction of arrow
19. Wall (may be omitted)
20. Mounting bracket
21. Edge
22. Reference point
23. Lower edge
31. Electric motor
32. Support plate
33. Upper anchoring plate
34. Rubber elements
35. Turbine

What is claimed is:

1. A dust exhauster, providing electric component cooling comprising: an electric motor connected to a lower plate and connected to an upper anchoring plate; electric components vertically and horizontally mounted on boards inside a U-shaped motor cooling intake channel providing cooling air for the electric motor, wherein the electric motor is a commutatorless D.C. motor and at least one of the vertically and horizontally mounted boards are positioned within the U-shaped motor cooling air intake channel, the motor cooling intake channel having a first vertical channel positioned in the direction of cooling air flow, a horizontal section connected to one end of the first channel, and a second vertical channel connected to the opposing end of the horizontal section, the second vertical channel of the U-shaped motor cooling channel being hermetically connected to an upper part of the electric motor.

2. A dust exhauster providing electric component cooling for a single motor, comprising:

a vacuum cleaner having a D.C. commutatorless electric motor; a U-shaped motor cooling intake channel having a first vertical channel, a horizontal channel connected to one end of said first vertical channel, and a second vertical channel connected to the opposing end of said horizontal channel;

a hermetic seal between said second vertical channel of said U-shaped motor cooling intake channel and the stationary winding section of said D.C. commutatorless electric motor; and at least one electronic component board, positioned vertically within said first and said second vertical channel or positioned horizontally within said horizontal channel, said electronic component board supporting at least one of the electronic components.

3. A dust exhauster providing electric component cooling for a multiplicity of electric motors configured in a circle, comprising: at least two D.C. commutatorless electric motors configured around the circumference of a circle, at least one U-shaped motor cooling intake channel for each of said D.C. commutatorless electric motors, each of said U-shaped motor cooling intake channels having a first vertical channel, a horizontal channel connected to one end of said first vertical channel and a second vertical channel connected to the opposing end of said horizontal channel, at least one hermetic seal between each of said second vertical channels, of said U-shaped motor cooling intake channels and the stationary winding sections of said D.C. commutatorless electric motors; and at least one electric component board, positioned vertically within said first and said second vertical channels or positioned horizontally within said horizontal channels, said electronic component boards supporting at least one of the electric components.

* * * * *